US005289812A

United States Patent [19]

Trombley et al.

[11] Patent Number: 5,289,812

[45] Date of Patent: Mar. 1, 1994

[54] INTERNAL COMBUSTION ENGINE AIR/FUEL RATIO COMPENSATION

[75] Inventors: Douglas E. Trombley, Grosse Pointe; Kenneth J. Buslepp, Shelby Township, Macomb County; William C. Albertson, Sterling Height, all of Mich.

[73] Assignee: General Motors Corporation, Detroit, Mich.

[21] Appl. No.: 69,464

[22] Filed: Jun. 1, 1993

[51] Int. Cl.[5] ..... F02M 67/02

[52] U.S. Cl. ..... 123/533

[58] Field of Search ..... 123/531, 532, 533, 534, 123/535

[56] References Cited

U.S. PATENT DOCUMENTS 4,327,688 5/1982 Lowther ..... 123/435
4,899,714 2/1990 Schechter et al. ..... 123/533
4,993,394 2/1991 McKay et al. ..... 123/533
5,024,201 6/1991 Kobayashi et al. ..... 123/531
5,024,202 6/1991 McKay ..... 123/533
5,085,189 2/1992 Huang et al. ..... 123/533 X
5,150,692 9/1992 Trombley et al. ..... 123/533
5,156,133 10/1992 Sugimoto et al. ..... 123/533
5,207,204 5/1993 Kawachi et al. ..... 123/533

*Primary Examiner*—Willis R. Wolfe
*Attorney, Agent, or Firm*—Howard N. Conkey

[57] ABSTRACT

Engine inlet air/fuel ratio compensation is applied to an internal combustion engine having pneumatic fuel injection, wherein the difference between a value proportional to inlet air pressure and a value proportional to inlet fuel pressure is monitored and a commanded fuel or air quantity adjusted as a predetermined function of the difference.

6 Claims, 2 Drawing Sheets

INTERNAL COMBUSTION ENGINE AIR/FUEL RATIO COMPENSATION

FIELD OF THE INVENTION

This invention relates to internal combustion engine control and, more specifically, to compensation for air and fuel pressure perturbations in an internal combustion engine having pneumatic fuel injection.

BACKGROUND OF THE INVENTION

It is known that internal combustion engines may be fueled by injecting a pressurized fuel stream to a high pressure air stream and metering the combination to an internal combustion engine. Fuel is injected to the air stream for a duration controlled by the width of a fuel pulse, and the fuel air combination is injected to the engine for a duration controlled by the width of an air pulse. The combination may be metered to a single air intake manifold for distribution to the cylinders of the engine or may be directly metered to each of the cylinders.

In such pneumatic fuel injection systems, the pressure of the air is regulated to a predetermined pressure above atmospheric pressure and the pressure of the fuel is regulated to a predetermined pressure above the air pressure. The difference between the air pressure and the fuel pressure may be used in a computation of the desired fuel pulse duration and the desired air pulse duration in accord with generally known engine air/fuel ratio control principles. For precise engine air/fuel ratio control, the pressure difference must remain substantially static or must be compensated, for example by sensing any significant perturbations in the pressure difference and adjusting the pulse duration as necessary.

Perturbations in the pressure difference have been attributed to several sources. Practical sources of the pressurized air, such as conventional air compressors provide an air stream having periodic pressure undulations around the desired compressor output air pressure. Likewise, conventional fuel pumps provide a fuel stream having periodic pressure undulations around the desired output fuel pressure. Other sources of pressure perturbations include changes in the load across the compressor or fuel pump supply voltage, such as from other electrical devices driven by the supply voltage. A temporary perturbation from a desired compressor or fuel pump drive rate may result from the load changes, at least temporarily affecting output pressure. Yet another perturbation source is the periodic opening and closing of fuel and air injectors in the system, which temporarily relieve pressure in the system.

To maintain a substantially constant air and fuel pressure despite these perturbations, air and fuel pressure regulators may be provided in the air and fuel paths, as described. However, practical regulators are incapable of rapidly responding to the described transient perturbations. Accordingly, further attempts have been made to minimize the pressure perturbations. These include providing a large damping orifice at the air compressor output, moving the air and fuel pressure regulators close to the injection points to improve regulator response, and providing diaphragm interfaces between the air and fuel paths wherein the diaphragms are deflected in response to pressure perturbations to minimize the difference in pressure. While these further attempts have reduced the pressure perturbations, a significant degradation in engine air/fuel ratio remains.

Furthermore, these further attempts have added significant cost and complexity to the fuel delivery system.

Accordingly, what is needed is an approach to air and fuel pressure disturbance compensation that maintains an acceptable air/fuel ratio to the engine despite such disturbances, and does not materially increase system cost or complexity.

SUMMARY OF THE INVENTION

The present invention overcomes the shortcomings of the prior compensation attempts by measuring transient changes in relative pressure and adjusting the commanded fuel or air pulse duration as needed in response thereto in direction to maintain a desired air/fuel ratio to the engine.

More specifically, air and fuel pressure are monitored and the difference therebetween used as the basis for modulating the length of the duration of the fuel or air injection pulse issued to each of the fuel or air injectors of the engine. In one embodiment, the pressure difference is periodically integrated over predetermined time periods, such as over the duration of each issued injector base pulse, so that significant transient pressure fluctuations may not be missed in the compensation. In another embodiment, an appropriate controller may sample the pressure difference at a high sampling rate and determine an appropriate fuel or air pulse correction in response thereto.

DESCRIPTION OF THE DRAWINGS

The invention may be best understood by reference to the preferred embodiment and to the drawings in which.

DESCRIPTION OF THE PREFERRED EMBODIMENT

Figure 1:
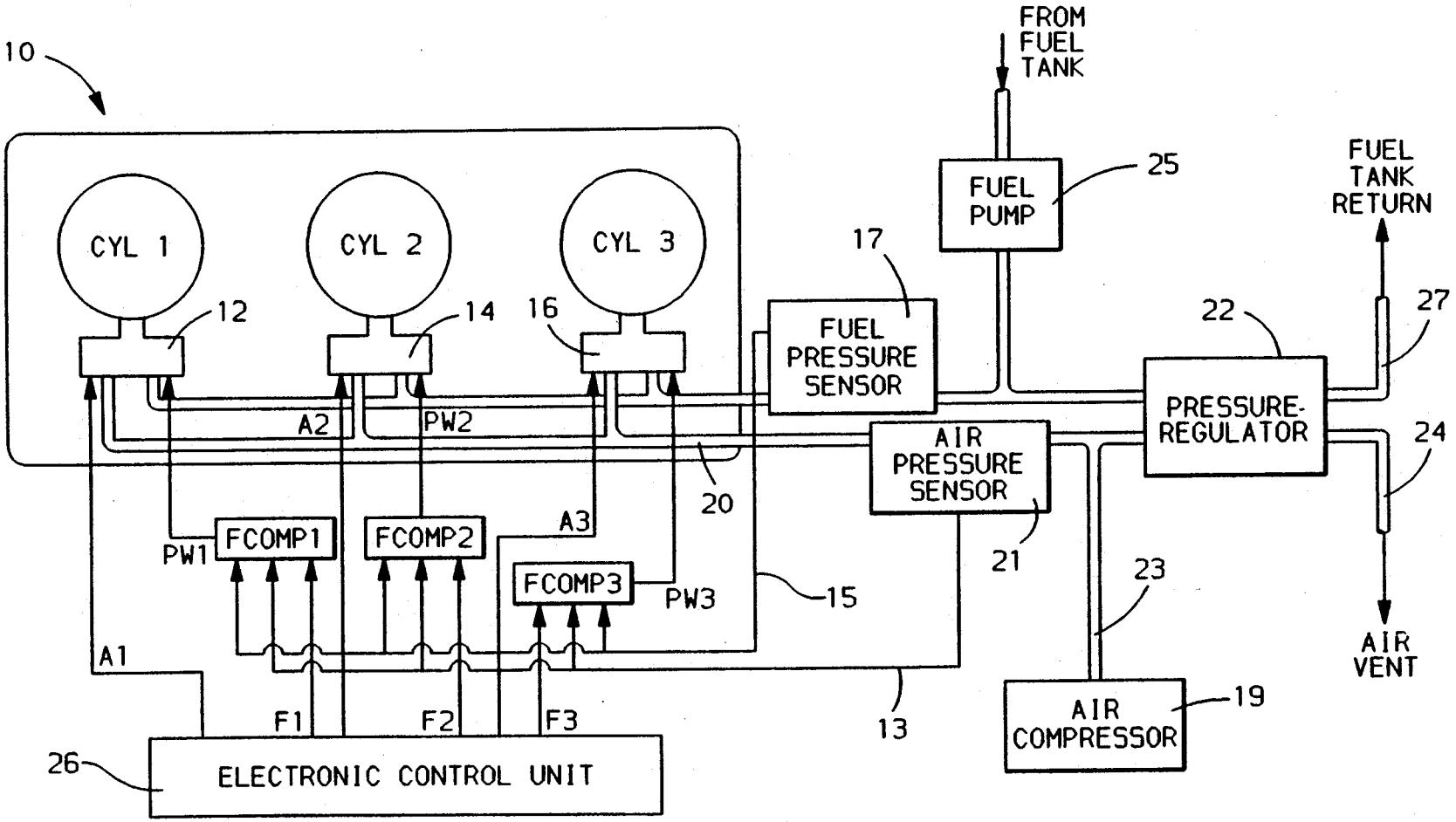
FIG. 1 is a general diagram of a two cycle engine and engine control unit in which the compensation in accord with a preferred embodiment of this invention is provided.

Referring to FIG. 1, a multicylinder internal combustion engine 10 is shown, having cylinders CYL 1, CYL 2, and CYL 3. Each cylinder is directly fueled by a conventional pneumatic fuel injection system including dedicated selectively operable solenoid actuated fuel injectors 12, 14, and 16, with a fuel conduit 18 and an air conduit 20 for delivering pressurized fuel and air to the injectors.

An air supply, such as a conventional air compressor 19 driven by the engine 10 provides pressurized air to the air conduit 20. A conventional air pressure sensor 21 is provided in the air conduit 20 for measuring the pressure of air passing through the conduit 20 by the sensor 21 and for providing an output signal on line 13 indicative of the measured pressure.

Pressurized fuel is delivered to injectors 12, 14, and 16 via fuel conduit 18 by the action of fuel pump 25 which draws fuel from a fuel tank (not shown). A conventional fuel pressure sensor 17 is provided in the fuel conduit 18 for measuring the pressure of the fuel passing thereby and for providing an output signal on line 15 indicative of the measured fuel pressure.

Conventional reference type fuel/air pressure regulator 22 regulates the maximum pressure of fuel in conduit 18 and the maximum pressure of air in conduit 20. The regulator 22 is of the type commonly used in pneumatic fuel injection systems for maintaining a fixed differential pressure between the fuel and air in the respective conduits.

The air pressure in the regulator is regulated at a predetermined air pressure above atmospheric pressure wherein the regulator in a conventional fashion vents excess air from the air conduit 23 through conduit 24 to the engine evaporative canister (not shown) or to the engine intake manifold (not shown) when the air pressure in conduit 23 exceeds the predetermined air pressure.

The pressure of fuel in conduit 18 is likewise regulated to a predetermined fuel pressure which is set a predetermined offset above the predetermined air pressure. When the fuel pressure in conduit 18 exceeds the predetermined fuel pressure, the pressure regulator 22 vents fuel through conduit 27 back to the fuel tank (not shown) to relieve the excess pressure. In the preferred embodiment, the predetermined air pressure may be set as 550 kPa above atmospheric pressure and the predetermined fuel pressure be set at 70 kPa above that of the air pressure, or approximately 620 kPa above atmospheric pressure.

A conventional electronic control unit ECU 26, such as a conventional single chip microcontroller processes generally known operating condition inputs from various conventional sensors and communicates appropriate engine control commands to various conventional actuators in accord with generally understood principles of engine control. In the conventional pneumatic fuel injection system of this embodiment, the ECU 26 looks up a desired fuel per cylinder value from a table stored in ECU memory, for example as a function of engine speed and a commanded engine operating point from the engine operator. The ECU 26 then generates pulse signals F1–F3 and A1–A3 for respectively actuating fuel and air solenoids (not shown) within fuel injectors 12, 14, and 16, at appropriate times in each engine cycle. Each of the fuel pulses F1–F3 is passed to respective compensating circuits FCOMP1–FCOMP3, to be described, each of which output a pulse signal PW1–PW3 to fuel solenoids of injectors 12, 14, and 16, respectively. The width of the output pulses PW1–PW3 determines the metered quantity of fuel that is deposited in a holding chamber within each of the respective fuel injectors 12, 14 and 16.

In this embodiment of the invention, the width of the fuel pulses F1–F3 should be calibrated using the maximum expected pressure difference between air pressure in the air conduit 20 and fuel pressure in the fuel conduit 18, such as 90 kPa. Otherwise, the pulse width should be calibrated consistent with general pneumatic fuel injection practices.

The air pulses A1–A3 are timed by the ECU 26 to open each nozzle (not shown) of the respective fuel injectors 12, 14, and 16, to initiate the start of cylinder fuel injection. The width of each air pulse A1–A3, commonly referred to as the cylinder injection period, determines the length of time that each injector nozzle remains open and consequently the timing of the end of cylinder injection. During the cylinder injection period, pressurized air from the air supply enters an injector and drives the metered fuel from its holding chamber through the open nozzle and directly into the associated engine cylinder. The pressurized air serves to atomize the fuel for clean combustion and enables the fuel to be injected directly into a combustion chamber against opposing cylinder combustion pressure.

In accord with this embodiment of the invention, each of the fuel pulses F1–F3 is passed through a dedicated compensation circuit FCOMP1–FCOMP3 respectively, as described, for adjustment of the duration of the commanded fuel pulse F1–F3 in accord with this invention to compensate for pressure difference perturbations between delivered fuel and air, as will be described. In addition to receiving its respective fuel command F1–F3, each of the compensation circuits FCOMP1–FCOMP3 receives the output signal from the air pressure sensor 21 on line 13, and receives the output signal from the fuel pressure sensor 17 on line 15. The operation of the compensation circuits FCOMP-1–FCOMP3 on the respective fuel commands F1–F3 is identical, and one such operation is detailed by the circuit schematic of FIG. 2. The inventors do not intend to limit the fuel command compensation of this invention to the specific circuitry of FIG. 2. Rather, the inventors intend that any manner of adjusting commanded fuel to the engine in response to changes in the difference between air and fuel pressure so as to maintain an appropriate air/fuel ratio in the engine is within the scope of this invention.

Figure 2:
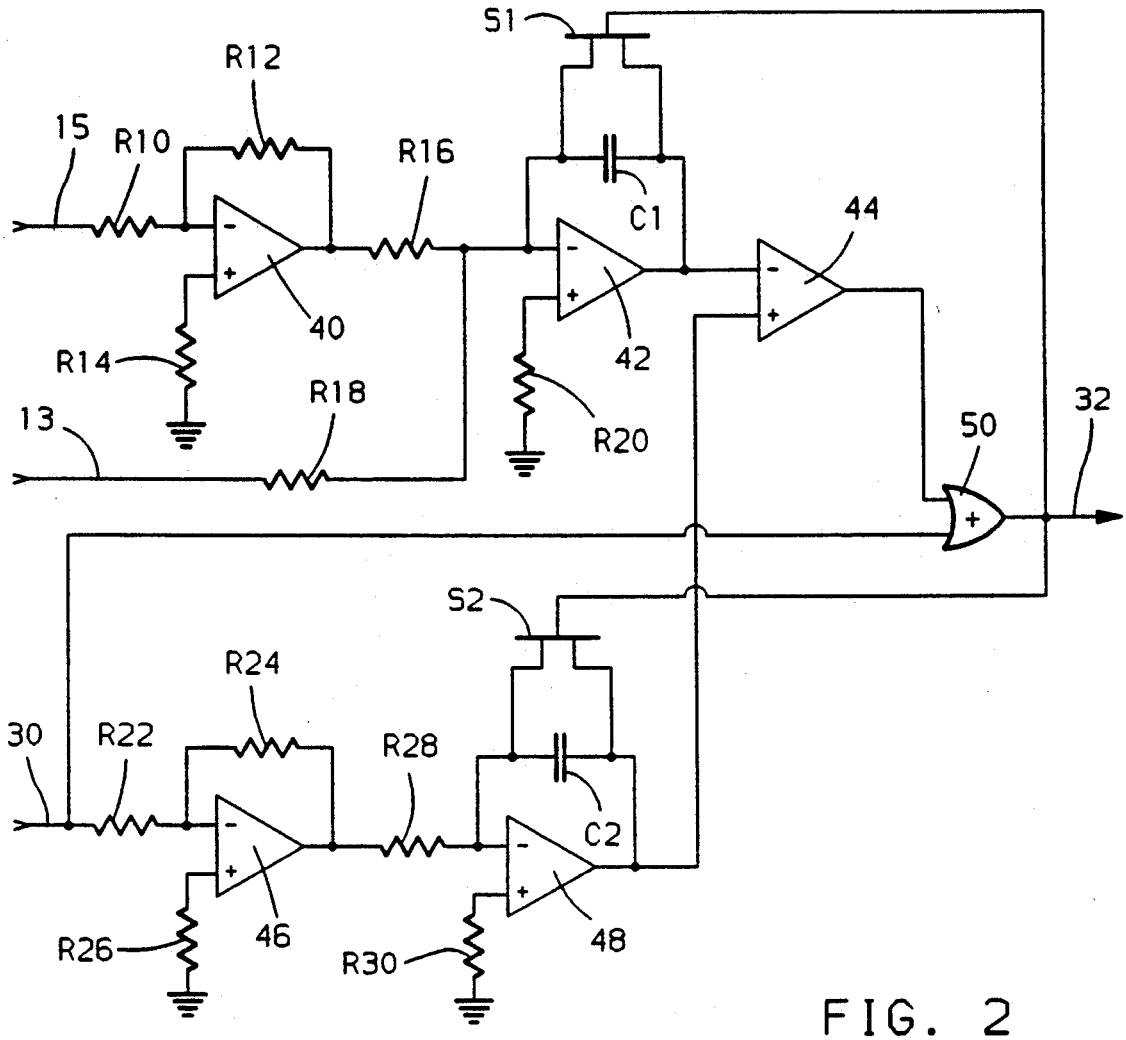
FIG. 2 is a schematic of a compensation circuit for carrying out the principles of this invention in accord with the diagram of FIG. 1.

Turning to the embodiment illustrated in FIG. 2, fuel pressure sensor 17 (FIG. 1) communicates an output pressure signal on line 15 through series resistor R10 of ten kilo-ohms to inverting amplifier 40, with approximately unity gain, including feedback resistor R12 of approximately ten kilo-ohms, and pulldown resistor R14 of approximately 5.1 kilo-ohms. This inverting amplifier is provided to invert the fuel pressure signal from line 15 for later comparison to an air pressure signal on line 13.

The output of inverting amplifier 40 is passed through series resistor R16 of ten kilo-ohms to the inverting node of integrator 42. The air pressure sensor 21 (FIG. 1) provides an output signal on line 13 as described, which is passed in the compensation circuit of FIG. 2 through series resistor R18 of ten kilo-ohms to the inverting input of integrator 42, to thus be added to the comparator 40 output signal, which is the inverted fuel pressure signal. The inverting input to integrator 42 is therefore a difference between the air and fuel pressure signals. This pressure difference is monitored in this embodiment and changes thereto compensated by adjusting the fuel pulse width duration, as will be described.

Op amp 42 is connected in a conventional integrating configuration with pull-down resistor R20 of 5.1 kilo-ohms, feedback capacitor C1 of 0.2 micro-Farads, and thus from the ten kilo-ohm input resistors, has a time constant of approximately 2 milliseconds. The integrator output is provided to the inverting input of comparator 44. Analog switch S1 is connected from the input to the output of op amp 42 to bypass the integrator when closed, and to start integration when open, as will be described.

A commanded fuel pulse width, such as one of the described commands F1–F3 of FIG. 1, is provided to the circuit of FIG. 2 on line 30. In this embodiment, the commanded pulse width is a square wave of duration equal to the amount of time the associated fuel injector should meter fuel to the associated holding chamber, as described. The pulse width on line 30 of FIG. 2 is provided to inverting, unity gain amplifier including op amp 46 configured with feedback resistor R24 of ten kilo-ohms, series input resistor R22 of ten kilo-ohms, and pull-down resistor R26 of 5.1 kilo-ohms.

Accordingly the output of inverting amplifier including op amp 46 is an inverted version of the signal on line 30. This inverted signal is provided to integrating op amp 48, including feedback capacitor C2 of one micro-Farad, series input resistor R28 of ten kilo-ohms, an pull-down resistor R30 of ten kilo-ohms. The integrator time constant in this embodiment is thus approximately ten milliseconds. The integrator output is provided to the non-inverting input of comparator 44, for comparison with the described integrated pressure difference. Analog switch S2 is connected from the input to the output of op amp 48 to bypass the integrator when closed, and to start a new integration when open, as will be described.

Comparator 44 output is provided to two input OR gate 50. The pulse width signal on line 30 is provided as the second input to OR gate 50. Or gate 50 output is provided as the control input to analog switches S1 and S2, wherein when the OR gate output is low, the switches S1 ad S2 disable integration of integrating op amps 42 and 48 by shorting the op amp inputs through to the output. Alternatively, when OR gate output is high, which is when the fuel command on line 30 is high or when comparator 44 output is high or both, the switches S1 and S2 will close, allowing integration by op amps 42 and 48 to begin. The output of OR gate 50 is provided on line 32 as the compensated fuel pulse command, such as the command issues as PW1–PW3 in FIG. 1.

Functionally, the circuit of FIG. 2 operates to start the metering of fuel to the injector connected to output line 32 at the commanded start time from the pulse on line 30, by passing that pulse through to the OR gate 50, so that the output line 32 will be driven high substantially at the time the line 30 is driven high. The end of the pulse however is compensated by the circuit of FIG. 2, by extending when necessary, the time at which the pulse on line 32 returns low, as follows.

When the fuel pulse on line 30 switches high, the output of OR gate 50 is driven high, opening switches S1 and S2, which allows integrating op amps 42 and 48 to begin integrating their inputs. Op amp 42, with its time constant of 2 milliseconds, integrates the difference between the fuel pressure signal from amplifier 40 and the air pressure signal from line 13. In this embodiment, the fuel pressure is normally greater than the air pressure, so the output of integrating op amp 42 normally has positive slope.

Op amp 48, with its time constant of approximately ten milliseconds, integrates the constant magnitude fuel pulse from line 30, and thus has an output slope with a constant rate of increase while the fuel pulse is high. Knowing this rate of increase, the integration rate of integrating op amp 42 may be set so that its output magnitude crosses the increasing op amp 48 output at a predetermined time after the start of the fuel pulse, wherein the predetermined time is a function of the deviation in a fuel to air pressure difference from a desired pressure difference.

The two integrating op amps 42 and 48 are compared by comparator 44 which outputs a high signal while the integrated fuel pulse from integrating op amp 48 exceeds the integrated pressure difference from integrating op amp 42. As long as the comparator output remains high, the fuel pulse command out of the OR gate 50 will remain high, allowing fuel to be metered to the appropriate holding chamber.

The output of OR gate 50 will remain high for at least as long as the uncompensated fuel pulse on line 30, such that the compensation provided by the circuit of FIG. 2 cannot shorten the fuel pulse duration, as would be appropriate for increases in the pressure difference. However, as described in this embodiment, a maximum pressure difference is assumed in the calculation of the uncompensated fuel pulse duration, so that a minimum pulse duration is applied to the circuit of FIG. 2 on line 30. Then, any pressure difference less than that maximum expected difference may be compensated by the simple and inexpensive circuit of this embodiment.

In this embodiment, the maximum pressure difference between fuel and air is approximately 90 kPa. Therefore, in the calibration of an appropriate uncompensated fuel pulse duration, a pressure difference of 90 kPa is assumed. In the event such a maximum pressure is substantially sustained for the integration period of integrating op amp 42, then the circuit of FIG. 2 should be calibrated by determining appropriate time constants for integrating op amps 42 and 48 to provide no adjustment to the pulse duration on line 30.

Figure 3:
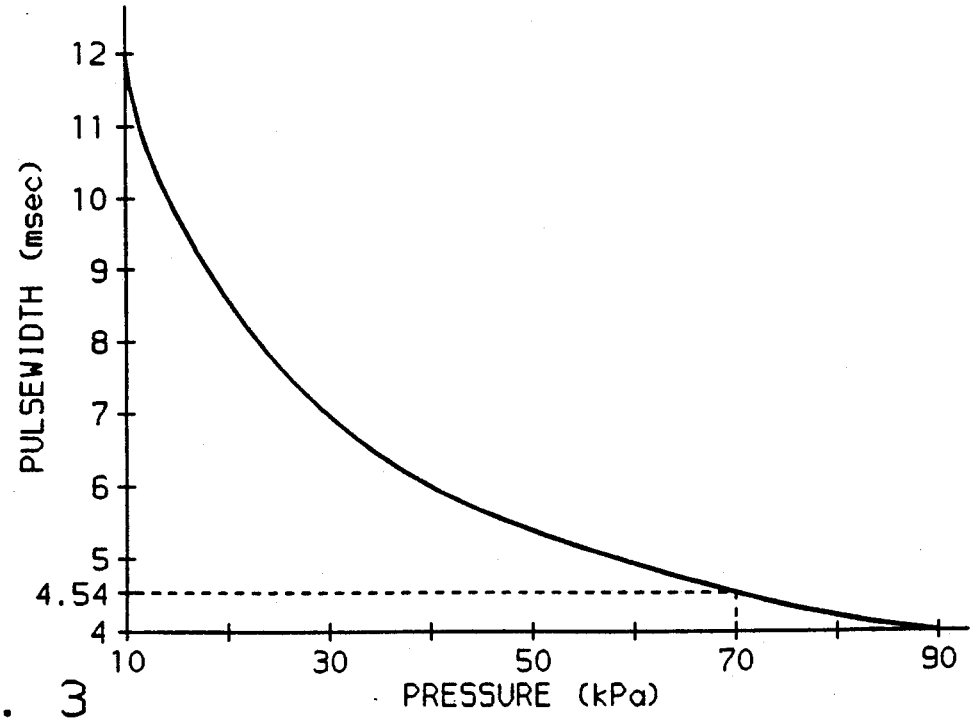
FIG. 3 is a graph illustrating a relationship between change in a pressure difference and change in desired fuel rate to an engine as used in an embodiment of this invention.

However, a progressively increasing duration should be provided for pressure decreases below 90 kPa. The increased duration is provided via integrating op amp 42, which will, under normal operating conditions, have an increasing output, as fuel pressure is regulated approximately 70 kPa above air pressure. The magnitude of the integrator differential input, and thus the slope of its increasing output will decrease as pressure difference decreases less than the maximum 90 kPa, requiring more time to drive the comparator 44 output low. This results in an approximate linear increase in the fuel pulse duration output on line 32. An appropriate rate of increase in fuel pulse duration per unit decrease in pressure difference must be determined for the system to which the circuit of FIG. 2 is applied and must reflect the relationship between fuel to air pressure difference in pneumatic fuel injection systems and desired fuel pulse duration. FIG. 3 illustrates a typical relationship between change in pressure below the maximum expected 90 kPa of pressure and the change in commanded fuel pulse duration, from the uncompensated pulse duration of approximately four milliseconds at ninety kPa, to approximately twelve milliseconds at ten kPa. Such a relationship is generally known in the pneumatic fuel injection art, and such general knowledge should guide the calibration of the circuit of FIG. 2, including selection of the time constants of integrators 42 and 48.

The compensation described in this embodiment for decreases in the pressure difference below the maximum expected pressure difference does not precisely reflect any non-linearities that may exist in the relationship between pressure and flow through an orifice. Specifically in this embodiment, the non-linearities between changes in the pressure difference between fuel and air and appropriate changes to commanded fuel pulse duration are not precisely accounted for in the compensation provided by the circuit of FIG. 2.

Well-established circuit design principles may be employed in addition to or as a substitute to that of FIG. 2 in accord with this invention to more accurately reflect such non-linearities. For example, the difference in pressure may be monitored over a predetermined period of time by means of analog circuitry such as the integrator 42 of FIG. 2. The integrator output may be provided to an analog to digital converter which is periodically polled by a digital device, such as a digital controller. The integrator would then be reset until the start of a subsequent test period. The digital controller may then apply the information from the converter to a stored model of the relationship between pressure difference and desired fuel pulse duration, adjust a base fuel pulse width such that a beneficial amount of fuel is metered to the holding chamber for the sensed pressure difference, and output the adjusted pulse width to an injector.

The preferred embodiment for the purpose of explaining this invention is not to be taken as limiting or restricting the invention since many modifications may be made through the exercise of skill in the art without departing from the scope of the invention.

The embodiments of the invention in which a property or privilege is claimed are described as follows:

1. A method for compensating a ratio of fuel to air admitted to an internal combustion engine having pneumatic fuel injection, wherein a quantity of air from a pressurized air supply is provided to inject a quantity of fuel from a fuel supply into the engine, comprising the steps of:

sensing pressure of fuel from the fuel supply;

sensing pressure of air from the air supply;

determining a difference between the sensed fuel pressure and the sensed air pressure;

generating a compensation value as a predetermined function of the determined difference; and adjusting a predetermined one of the group consisting of the fuel quantity and the air quantity by the generated compensation value.

2. The method of claim 1, further comprising the steps of:

determining a fuel pressure value as a predetermined function of sensed fuel pressure over a predetermined time period;

determining an air pressure value as a predetermined function of sensed air pressure over the predetermined time period; and wherein the difference determining step determines a difference between the determined fuel pressure value and the determined air pressure value.

3. The method of claim 2, wherein the predetermined function of sensed fuel pressure is an integration of sensed fuel pressure and wherein the predetermined function of sensed air pressure is an integration of sensed air pressure.

4. An apparatus for compensating a ratio of fuel to air admitted to an internal combustion engine having pneumatic fuel injection, wherein a quantity of air from a pressurized air supply is provided to inject a quantity of fuel from a fuel supply into the engine, comprising:

a fuel pressure sensor positioned to sense pressure of fuel from the fuel supply;

an air pressure sensor positioned to sense pressure of air from the air supply;

means for determining a difference between sensed fuel pressure and sensed air pressure;

means for generating a compensation value as a predetermined function of the determined difference; and means for adjusting a predetermined one of the group consisting of the fuel quantity and the air quantity by the generated compensation value.

5. The apparatus of claim 4, further comprising:

fuel pressure value determining means for determining a fuel pressure value as a predetermined function of sensed fuel pressure over a predetermined time period;

air pressure value determining means for determining an air pressure value as a predetermined function of sensed air pressure over the predetermined time period; and wherein the difference determining means determines a difference between the determined fuel pressure value and the determined air pressure value.

6. The method of claim 5, wherein the fuel pressure value determining means is an integrator for integrating sensed fuel pressure and wherein the air pressure value determining means is an integrator for integrating sensed air pressure.

* * * * *